US006209984B1

(12) United States Patent
Kim

(10) Patent No.: US 6,209,984 B1
(45) Date of Patent: Apr. 3, 2001

(54) POWER SAVING INK JET PRINTER AND CONTROLLING METHOD THEREOF

(75) Inventor: Myung-Que Kim, Kyungki-do (KR)

(73) Assignee: Samsung Electronics Co., Suwon (KR)

( * ) Notice: Subject to any disclaimer, the term of this patent is extended or adjusted under 35 U.S.C. 154(b) by 0 days.

(21) Appl. No.: 09/066,874

(22) Filed: Apr. 28, 1998

(30) Foreign Application Priority Data

Apr. 28, 1997 (KR) ..... 97-15803

(51) Int. Cl.[7] ..... B41J 23/00
(52) U.S. Cl. ..... 347/37; 318/34
(58) Field of Search ..... 347/37, 104, 185, 347/197, 215, 217, 218; 101/488; 400/902, 903, 279, 582, 706, 61–62, 323; 342/37, 5, 19, 104; 318/34, 51, 65

(56) References Cited

U.S. PATENT DOCUMENTS 4,889,439 * 12/1989 Cook et al. ..... 400/904
4,893,953 * 1/1990 Kawakami et al. ..... 400/904
4,990,930 2/1991 Ludden et al. ..... 347/104
5,349,905 9/1994 Taylor et al. ..... 101/488
5,351,068 9/1994 Moon et al. ..... 347/101
5,368,402 * 11/1994 Takahashi et al. ..... 347/37
5,668,581 9/1997 Tsuji et al. ..... 347/37
5,857,787 * 1/1999 Ryan ..... 400/903

* cited by examiner

*Primary Examiner*—N. Le
*Assistant Examiner*—Shih-wen Hsieh
(74) *Attorney, Agent, or Firm*—Robert E. Bushnell, Esq.

(57) ABSTRACT

An ink jet printer which is designed to control the motions of horizontal and vertical drive motors collectively and thereby allow only one motor to be driven at time for the reduction of peak power consumption includes: a vertical drive motor for feeding and discharging a print paper; a horizontal drive motor for driving a carriage to carry an ink cartridge to a print position; an ASIC circuit section corresponding to a logic circuit for controlling the operations of the horizontal and vertical drive motors; an EEPROM saving initial setting values required to control the ASIC circuit section and a program for a system; a driver circuit for controlling the operations of the drive motors; and a converger for managing tasks requested by the driver circuit in a collective manner so as to prevent simultaneous driving of the vertical and horizontal drive motors.

11 Claims, 3 Drawing Sheets

POWER SAVING INK JET PRINTER AND CONTROLLING METHOD THEREOF

CLAIM OF PRIORITY

This application makes reference to, incorporates the same herein, and claims all benefits accruing under 35 U.S.C. §119 from an application for POWER-SAVING INK JET PRINTER earlier filed in the Korean Industrial Property Office on Apr. 28th, 1997 and there duly assigned Serial No. 15803/1997.

BACKGROUND OF THE INVENTION

1. Field of the Invention

The present invention relates to an ink jet printer and, more particularly, to a an ink jet printer which is adapted to reduce peak power consumption in the ink jet printer.

2. Description of the Related Art

Printers are a typical peripheral equipment output devices associated with computer so as to make a printed record of computer information for the user.

Particularly, an ink jet printer is commonly used as a low-priced printer which is excellent in print quality.

An ink jet printer has a CPU (Central Processing Unit) for receiving a signal from a host computer through its printer interface, reading a system program in an EEPROM (electrically erasable programmable read only memory) that stores initial values for operating the printer and the overall system, analyzing the stored values, and outputting control signals according to the content of the program; a ROM (read only memory) for storing a control program and several fonts; a RAM (random access memory) for temporarily storing data during system operation; an ASIC (Application Specific Integrated Circuit) circuit for transmitting data and control signals from the CPU to the various peripheral components; a head driver for controlling the operation of an ink cartridge according to the control signals transmitted from the ASIC circuit; a main motor driver for driving a main motor and for "parling" the ink cartridge; a carriage return motor driver for controlling the operation of a carriage return motor; and a line feed motor driver for controlling the operation of a line feed motor which is a stepping motor for feeding/discharging it paper.

In the operation of the above apparatus, a printing signal from the host computer is supplied through the printer interface thereof, to drive each of the motors according to the control signal of the CPU and thus perform printing. The ink cartridge forms dots by spraying fine ink drops through a plurality of openings in its nozzle.

Ink jet printers of such a construction have been developed for the improvement of a printing rate without any consideration of their peak power capacity. Consequently, the ink jet printers sometimes have to provide a high cost large size power supply section.

Peak power consumption increases usually because the vertical drive motor is driven to transfer the print paper in the vertical direction during a horizontal printing operation or during switching the carriage to the next print line.

That is, the carriage return motor is driven to allow the carriage to return to the start position of the next line after printing a line while the line-feed motor is driven to print the next line.

Such a simultaneous drive operation of the two motors inevitably accompanies increased peak power consumption in the ink jet printer.

Furthermore, it is necessary to design the ink jet printer in accordance with the maximum capacity of the power supply so that disadvantageously the entire system becomes much more expensive and larger in size.

The following patents each disclose features in common with the present invention but do not teach or suggest the specifically recited features of the ink jet printer having reduced peak power consumption of the present invention: U.S. Pat. No. 5,668,581 to Tsuji et al, entitled *Ink Jet Printing Apparatus,* U.S. Pat. No. 5,351,068 to Moon et al., entitled *Ink-Jet Printer Carriage And Paper Motion Overlap Method And Apparatus,* U.S. Pat. No. 4,990,930 to Ludden et al., entitled *High Speed Thermal Printing Apparatus,* and U.S. Pat. No. 5,349,905 to Taylor et al., entitled *Method And Apparatus For Controlling Peak Power Requirements Of A Printer.*

SUMMARY OF THE INVENTION

Accordingly, the present invention is directed to a power-saving ink jet printer that substantially obviates one or more of the problems due to limitations and disadvantages of the related art.

An object of the present invention is to provide a power-saving ink jet printer which is designed to control the motions of horizontal and vertical drive motors collectively and thereby allow only one motor to be driven at a specified point of time for the reduction of peak power consumption.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an ink jet printer having reduced peak power consumption includes: a vertical drive motor for feeding and discharging a print paper; a horizontal drive motor for driving a carriage to carry an ink cartridge to a print position; an ASIC circuit section corresponding to a logic circuit for controlling the operations of the horizontal and vertical drive motors; a memory means (EEPROM) for saving initial setting values required to control the ASIC circuit section and a program for a system; a driver circuit for controlling the operations of the drive motors; and a converger for managing tasks requested by the driver circuit in a collective manner so as to prevent simultaneous driving of the horizontal and vertical drive motors.

It is to be understood that both the foregoing general description and the following detailed description are exemplary and explanatory and are intended to provide further explanation of the invention as claimed.

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Reference will now be made in detail to the preferred embodiments of the present invention, examples of which are illustrated in the accompanying drawings.

Figure 1:
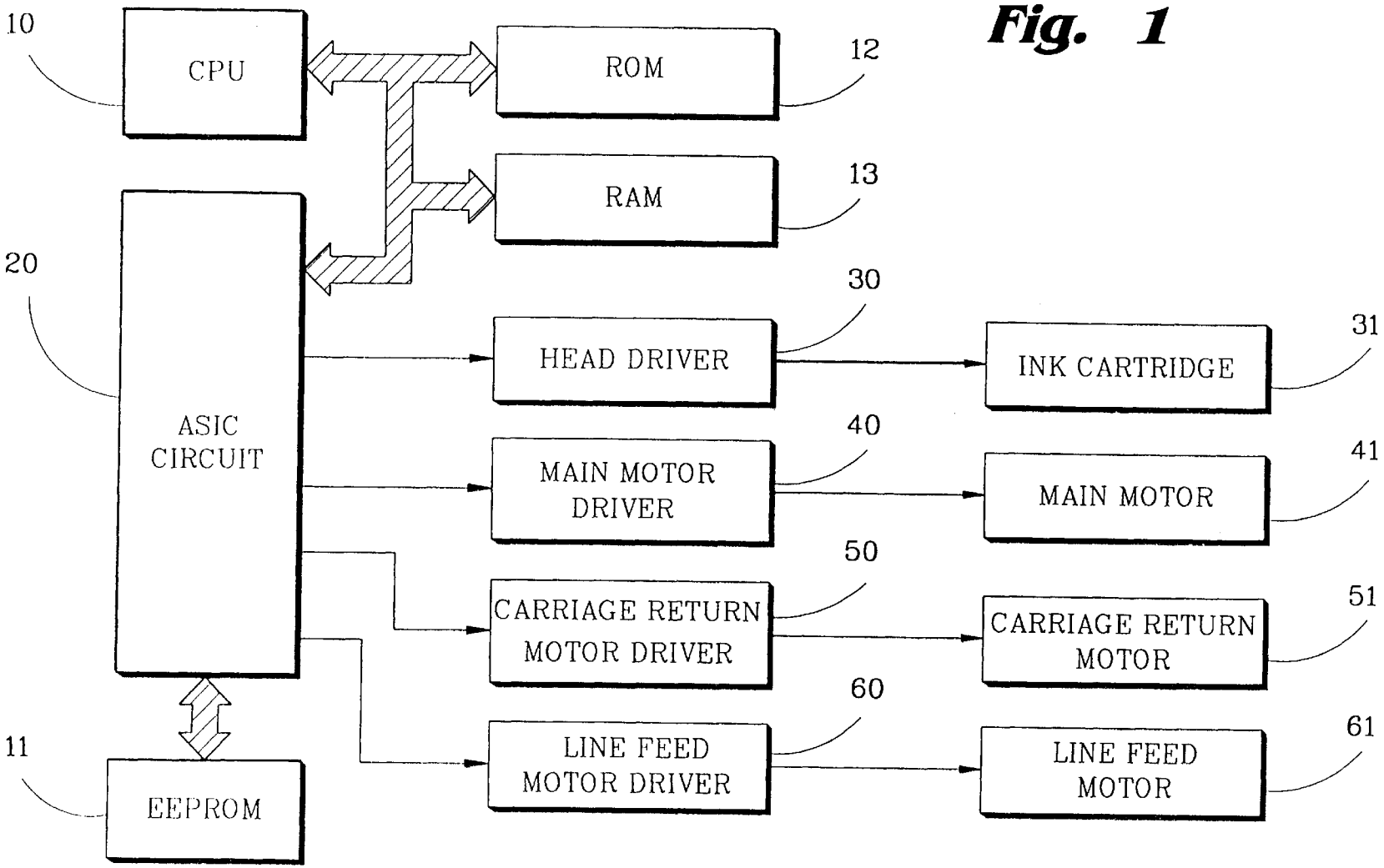
FIG. 1 is a block diagram illustrating the construction of an ink jet printer.

FIG. 1 illustrates an ink jet printer as noted above in the Description of the Related Art.

The ink jet printer has a CPU 10, and EEPROM 11, a ROM 12, A RAM (Random Access Memory) 13 and ASIC circuit 20, a head driver 30, a main motor driver 40, a main motor 41, a carriage return motor driver 50, a carriage return motor 51, a line feed motor driver 60 and a line feed motor 61.

Figure 2:
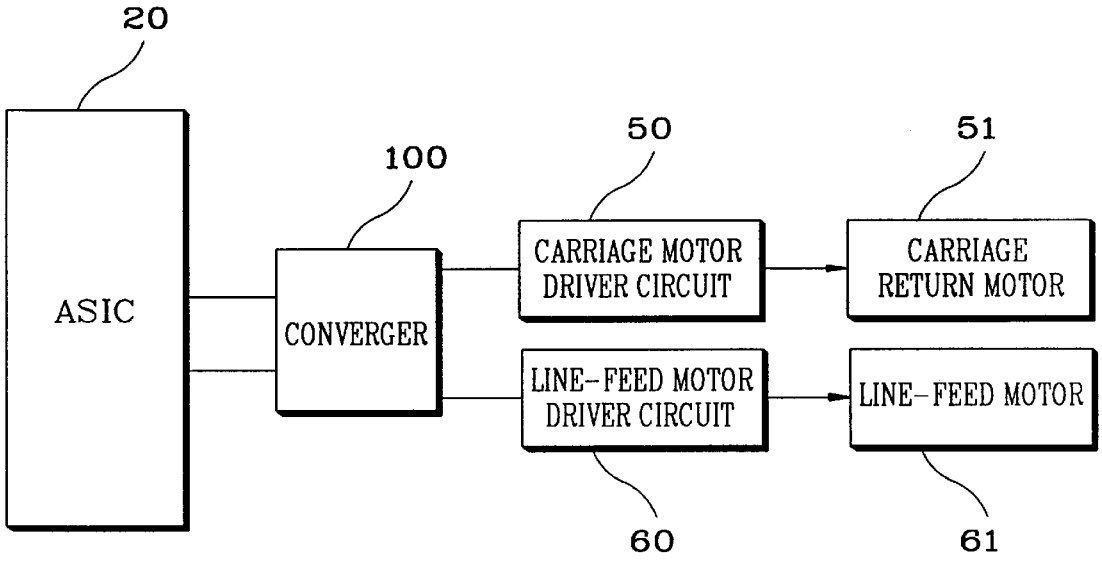
FIG. 2 is a block diagram illustrating the construction of an ink jet printer in accordance with the present invention.

FIG. 2 is a block diagram illustrating the internal construction of an ink jet printer in accordance with the present invention. Unlike the ink jet printer shown in FIG. 1, a converger 100 is disposed between ASIC circuit 20 and driver circuits 50 and 60.

Figure 3:
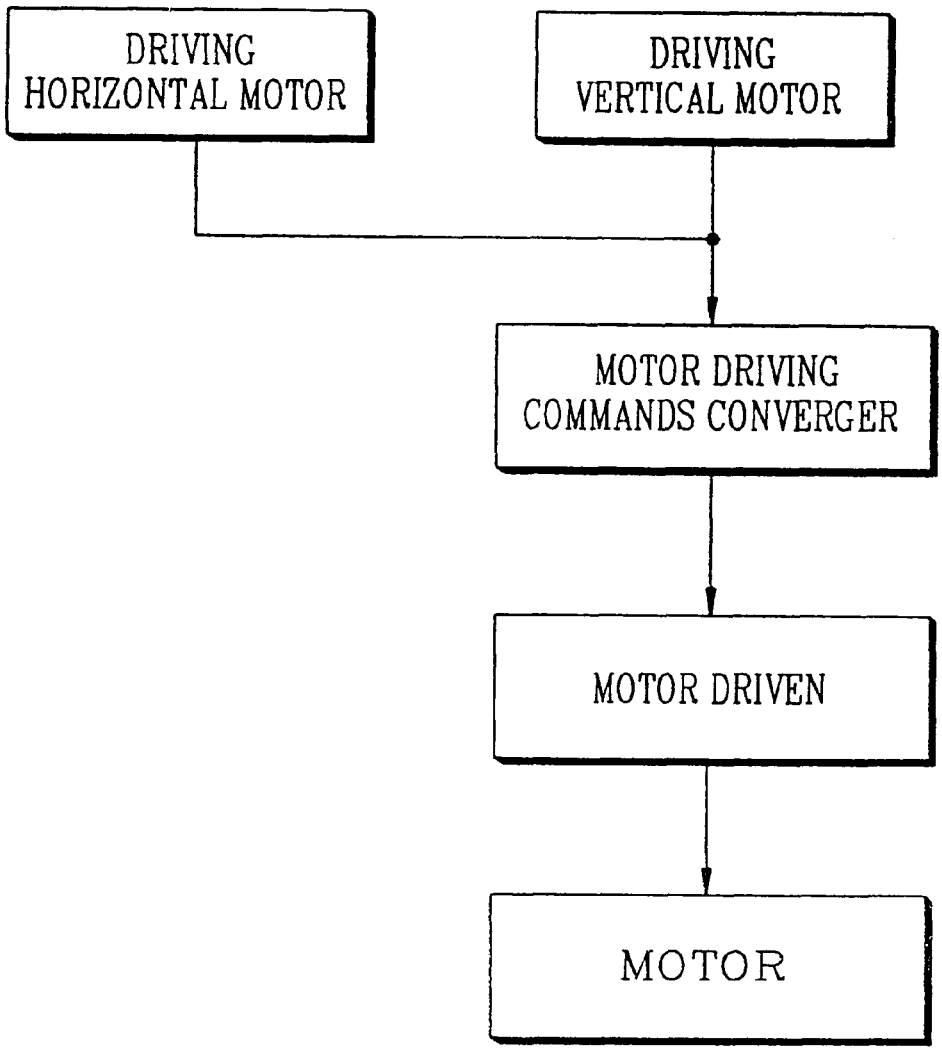
FIG. 3 is a flow diagram illustrating a operational command system of the present invention.

FIG. 3 illustrates an operational process between the ASIC circuit 20 and the converger 100. The ASIC circuit 20 generates control signals for a first task that makes request for driving a horizontal drive motor, a second task for driving a vertical drive motor.

The control signals are transmitted to the converger 100, which controls the two tasks collectively and transfers an operational signal sequentially to driver circuits 50 and 60, thereby driving the motors 51 and 61.

The output of the converger 100 is either "0" or "1", wherein "1" means the operation execution "ON" and "0" means the operation suspended "OFF". Upon printing a line completely, the output of the converger 100 is "1" for a horizontal motion and "0" for a vertical motion so that a carriage motor (horizontal motor) is driven to return the carriage to the start position on the next line. As the carriage returns to the start position, the output of the converger 100 is converted to "0" for the horizontal motion and "1" for the vertical motion, driving a line-feed motor (vertical motor) to transfer a paper.

That is, either one of the horizontal or vertical drive motors 41 and 51 is driven at a specified point of time.

In the present invention as described above, peak power consumption can be reduced because the two motors are not driven in a simultaneous manner.

It will be apparent to those skilled in the art that various modifications and variations can be made in the power-saving ink jet printer of the present invention without departing from the spirit or scope of the invention. Thus, it is intended that the present invention cover the modifications and variations of this invention provided they come within the scope of the appended claims and their equivalents.

What is claimed is:

1. An ink jet printer, comprising:

a vertical drive motor for feeding and discharging a print paper;

a horizontal drive motor for driving a carriage to carry an ink cartridge to a print position; an Application Specific Integrated Circuit for controlling the operations of the horizontal and vertical drive motors;

a memory for saving initial setting values required to control the Application Specific Integrate Circuit;

a carriage motor driver circuit for controlling an operation of the horizontal drive motor a line-feed motor driver circuit, for controlling an operation of the vertical drive motor;

a converger disposed between the Application Specific Integrated Circuit and the carriage motor driver circuit and line-feed motor driving circuit, for managing tasks requested by the driver circuit in a collective manner so as to prevent simultaneous driving of the vertical and horizontal drive motors.

2. The ink jet printer as defined in claim 1, the horizontal and vertical drive motors each comprising a stepping motor.

3. The ink jet printer as defined in claim 2, the horizontal and vertical drive motors being driven by DC power.

4. The ink jet printer as defined in claim 1, the horizontal and vertical drive motors being driven by DC power.

5. A printer, comprising:

a vertical drive motor for feeding and discharging a print paper;

a horizontal drive motor for driving a carriage to carry a print cartridge to a print position;

a vertical motor driver circuit for controlling operation of the vertical drive motor, a horizontal motor driver circuit for controlling operation of the horizontal drive motor an Application Specific Integrated Circuit for generating control signals for controlling the horizontal and vertical drive motors; and a converger disposed between the Application Specific Integrated Circuit and the carriage motor driver circuit and line-feed motor driving circuit, for managing tasks requested by the Application Specific Integrated Circuit in a collective manner so as to prevent simultaneous driving of the vertical and horizontal drive motors.

6. The ink jet printer as defined in claim 5, the horizontal and vertical drive motors each comprising a stepping motor.

7. The ink jet printer as defined in claim 6, the horizontal and vertical drive motors being driven by DC power.

8. The ink jet printer as defined in claim 5, the horizontal and vertical drive motors being driven by DC power.

9. A method of controlling an ink jet printer, the method comprising:

feeding and discharging a print paper with a vertical drive motor;

driving a carriage to carry an ink cartridge to a print position with a horizontal drive motor;

controlling the operations of the horizontal and vertical drive motors with an ASIC circuit section corresponding to a logic circuit;

saving initial setting values required to control the ASIC circuit and a converger in a collective manner so as to prevent a simultaneous driving of the vertical and horizontal drive motors.

10. A method of controlling a printer, comprising:

feeding and discharging a print paper with a vertical drive motor;

driving a carriage to carry a printer cartridge to a print position with a horizontal drive motor;

controlling the operations of the horizontal drive motor with a horizontal driver circuit controlling the operations of the vertical drive motor with a vertical driver circuit; and managing tasks requested by the horizontal and vertical driver circuits in a collective manner by use of a converser so as to prevent simultaneous driving of the vertical and horizontal drive motors.

11. A method for controlling an ink-jet printer, comprising the steps of:

generating first and second control signals, in an Application Specific Integrated Circuit, for respectively driving a carriage motor and for driving a line-feed motor of the ink jet printer;

transmitting said first and second control signals to a converger;

outputting from the converger signals to a carriage motor driver circuit connected to the carriage motor and to a line-feed driver circuit connected to the line-feed motor, such that only one of the carriage motor and line-feed motor is driven at any specified point of time.

* * * * *